US008035294B2

(12) United States Patent
Taniguchi et al.

(10) Patent No.: US 8,035,294 B2
(45) Date of Patent: Oct. 11, 2011

(54) ELECTRON BEAM APPARATUS AND IMAGE DISPLAY APPARATUS THEREWITH

(75) Inventors: Hirotomo Taniguchi, Saitama (JP); Toshiharu Sumiya, Ebina (JP); Hisanobu Azuma, Hadano (JP); Takanori Suwa, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/770,159

(22) Filed: Apr. 29, 2010

(65) Prior Publication Data

US 2010/0283380 A1 Nov. 11, 2010

(30) Foreign Application Priority Data

May 11, 2009 (JP) ..... 2009-114382

(51) Int. Cl.
*H01J 1/62* (2006.01)
*H01J 29/46* (2006.01)

(52) U.S. Cl. ..... 313/497; 313/495; 313/496; 313/306

(58) Field of Classification Search ..... 313/495–497, 313/306, 309–311; 445/24
See application file for complete search history.

(56) References Cited

U.S. PATENT DOCUMENTS

| | | | | |
|---|---|---|---|---|
| 6,703,791 | B2 | 3/2004 | Azuma | 315/169.3 |
| 6,972,203 | B2 | 12/2005 | Azuma | 438/20 |
| 7,151,005 | B2 | 12/2006 | Azuma | 438/20 |
| 7,381,578 | B2 | 6/2008 | Azuma | 438/20 |
| 7,382,088 | B2 | 6/2008 | Azuma et al. | 313/495 |
| 7,427,826 | B2 | 9/2008 | Iba et al. | 313/236 |
| 7,427,830 | B2 | 9/2008 | Taniguchi et al. | 313/495 |
| 7,507,134 | B2 | 3/2009 | Iba et al. | 445/5 |
| 7,710,010 | B2 | 5/2010 | Iba et al. | 313/477 R |
| 7,733,003 | B2 | 6/2010 | Hiroki et al. | 313/495 |
| 2008/0238287 | A1 | 10/2008 | Iba et al. | 313/458 |
| 2008/0309592 | A1 | 12/2008 | Ohashi et al. | 345/75.2 |
| 2009/0009438 | A1 | 1/2009 | Kanai et al. | 345/75.2 |
| 2009/0058252 | A1 | 3/2009 | Takada et al. | 313/310 |
| 2009/0072697 | A1 | 3/2009 | Hiroki et al. | 313/326 |

FOREIGN PATENT DOCUMENTS

JP 2001-167693 A 6/2001

*Primary Examiner* — Karabi Guharay
*Assistant Examiner* — Elmito Breval
(74) *Attorney, Agent, or Firm* — Fitzpatrick, Cella, Harper & Scinto

(57) ABSTRACT

In an electron beam apparatus including an electron emission element and an anode, the electron emission element includes a gate 5 and a cathode 6 having a projection portion. The gate 5 and the cathode 6 are located in a surface of an insulating member 3 including a recess 7. The projection portion of the cathode 6 has a height distribution, and an average value dav (m) of a shortest distance between the gate 5 and the projection portion of the cathode 6 and a difference h (m) between the average value dav and a shortest distance dmin (m) from the gate 5 to a maximum convex portion of the projection portion of the cathode 6 satisfy a relationship of h/dav<0.39.

6 Claims, 10 Drawing Sheets

ELECTRON BEAM APPARATUS AND IMAGE DISPLAY APPARATUS THEREWITH

BACKGROUND OF THE INVENTION

1. Field of the Invention

The present invention relates to an electron beam apparatus that is used in a flat panel display and includes electron emission elements emitting electrons, and an image display apparatus therewith.

2. Description of the Related Art

SUMMARY OF THE INVENTION

Conventionally, there is an electron emission element in which electrons are taken out after many electrons emitted from a cathode collide with and scatter from an opposite gate. For example, Japanese Patent Application Laid-Open No. 2001-167693 discloses a configuration of the laminated type electron emission element in which a recess is provided in an insulating layer near an electron emission portion.

Occasionally an electron emission characteristic varies when plural laminated type electron emission elements disclosed in Japanese Patent Application Laid-Open No. 2001-167693 are provided on a substrate to form an image display apparatus.

In view of the foregoing, an issue of the invention is to provide an electron beam apparatus that exhibits a uniform electron emission characteristic without variation even if the plural electron beam apparatuses are provided, and an image display apparatus in which the electron beam apparatus is used to display a high-quality image.

An electron beam apparatus according to this invention is that, an electron beam apparatus comprising:

an insulating member that includes a recess in a surface thereof;

a gate that is located in the surface of the insulating member;

a cathode that includes a projection portion projected from an edge of the recess toward the gate, and being located in the surface of the insulating member so that the projection portion is opposite the gate; and an anode that is disposed opposite the projection portion with the gate interposed therebetween, wherein, in a direction in which the insulating member and the gate are laminated, the projection portion of the cathode has a height distribution, and an average value dav (m) of a shortest distance between the gate and the projection portion of the cathode, and a difference h (m) between the average value dav (m) and a shortest distance dmin (m) from the gate to a maximum convex portion of the projection portion of the cathode satisfy the following relationship.

$$h/dav<0.39$$

An image display apparatus according to this invention is that, an image display apparatus comprising the electron beam apparatus described above, and a light emission member that is located while laminated on the anode.

According to the invention, the electron emission element having the uniform electron emission characteristic can be provided by restricting the convex height in the projection portion of the cathode, and the image display apparatus having the high-quality display can be formed using the electron emission element.

Further features of the present invention will become apparent from the following description of exemplary embodiments with reference to the attached drawings.

DESCRIPTION OF THE EMBODIMENTS

Exemplary embodiments of the invention will be described in detail with reference to the drawings. However, unless otherwise noted, the invention is not limited to a size, a material, and a shape of a component described in the embodiments and a relative arrangement of the components.

An electron beam apparatus according to an embodiment of the invention includes an electron emission element that emits electrons and an anode that the electrons emitted from the electron emission element reach. The electron emission element according to an embodiment of the invention includes an insulating member that has a recess in a surface thereof and a gate and a cathode. The gate and the cathode are located in the surface of the insulating member. The cathode includes a projection portion that is projected from an edge of the recess toward the gate, and the projection portion is located opposite the gate. A length in a direction along the edge of the recess of the projection portion is formed shorter than a length in the direction of a portion opposite the projection portion of the gate. The anode is disposed opposite the projection portion with the gate interposed therebetween.

(Outline of Configuration)

Figure 1A:
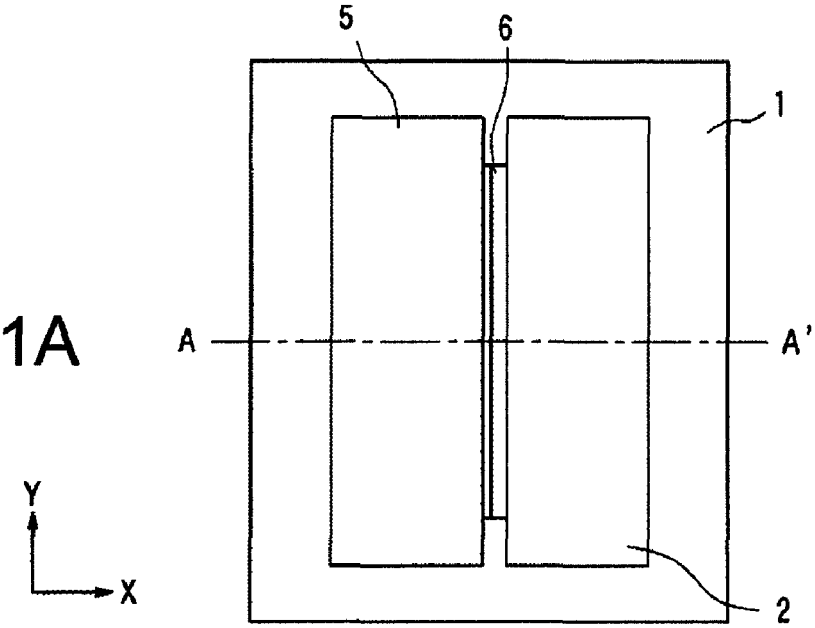
FIGS. 1A to 1C schematically illustrate a configuration of an electron emission element according to an embodiment of the invention.
Figure 1B:
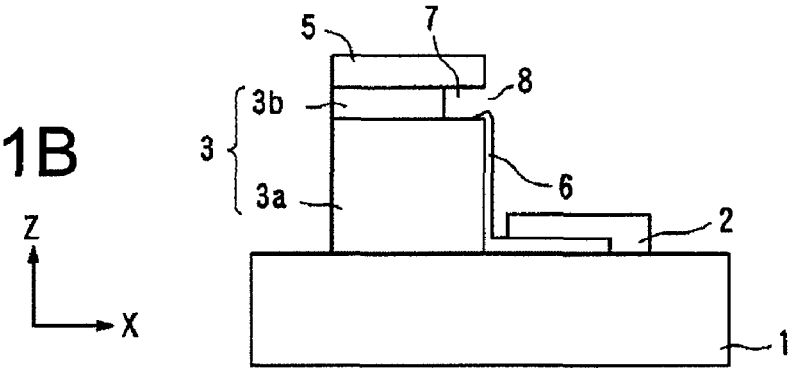
Figure 1C:
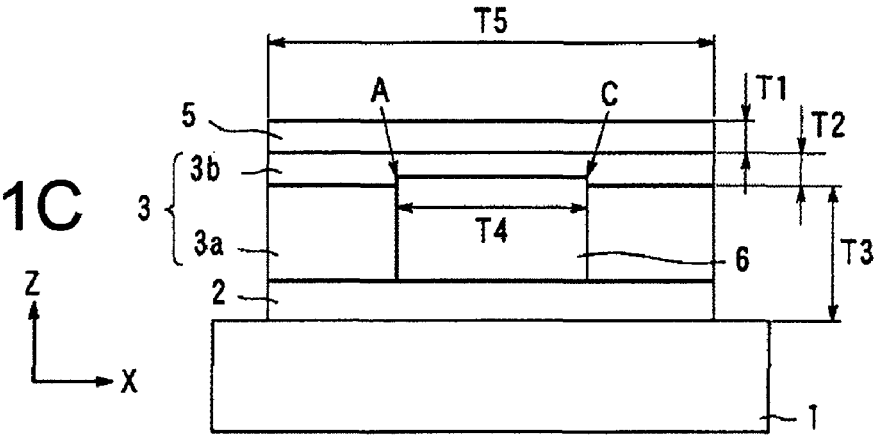

FIG. 1A is a schematic plan view of the electron emission element of the embodiment, FIG. 1B is a sectional view taken on a line A-A' of FIG. 1A, and FIG. 1C is a side view of the electron emission element when the electron emission element of FIG. 1B is viewed from the right.

Referring to FIGS. 1A to 1C, an electrode 2 and an insulating member are disposed on a substrate 1, and the insulating member 3 is a laminated body including insulating layers 3*a* and 3*b*. A gate 5 and a cathode 6 are electrically connected to the electrode 2. A recess 7 of the insulating member 3 is formed by inwardly concaving only a side face of the insulating layer 3*b* from the insulating layer 3*a*. An electric field necessary for the electron emission is formed in a gap 8.

In the electron emission element of the embodiment, as illustrated in FIG. 1, the gate 5 is formed in a surface (in the embodiment, upper surface) of the insulating member 3. The cathode 6 is also formed in the surface (in the embodiment, side face) of the insulating member 3 while including a projection portion that is projected from the edge of the recess 7 toward the gate 5 on the side of the recess 7 opposite the gate 5. Therefore, in the projection portion, the cathode 6 is located across the gap 8 from the gate 5. In the embodiment, a voltage at the cathode 6 is set lower than that of the gate 5. Although not illustrated in FIG. 1, the anode is located opposite the cathode 6 while the gate 5 is interposed therebetween, and the voltage at the anode is set higher than those of the gate 5 and cathode 6 (see numeral 20 of FIG. 3).

Figure 3:
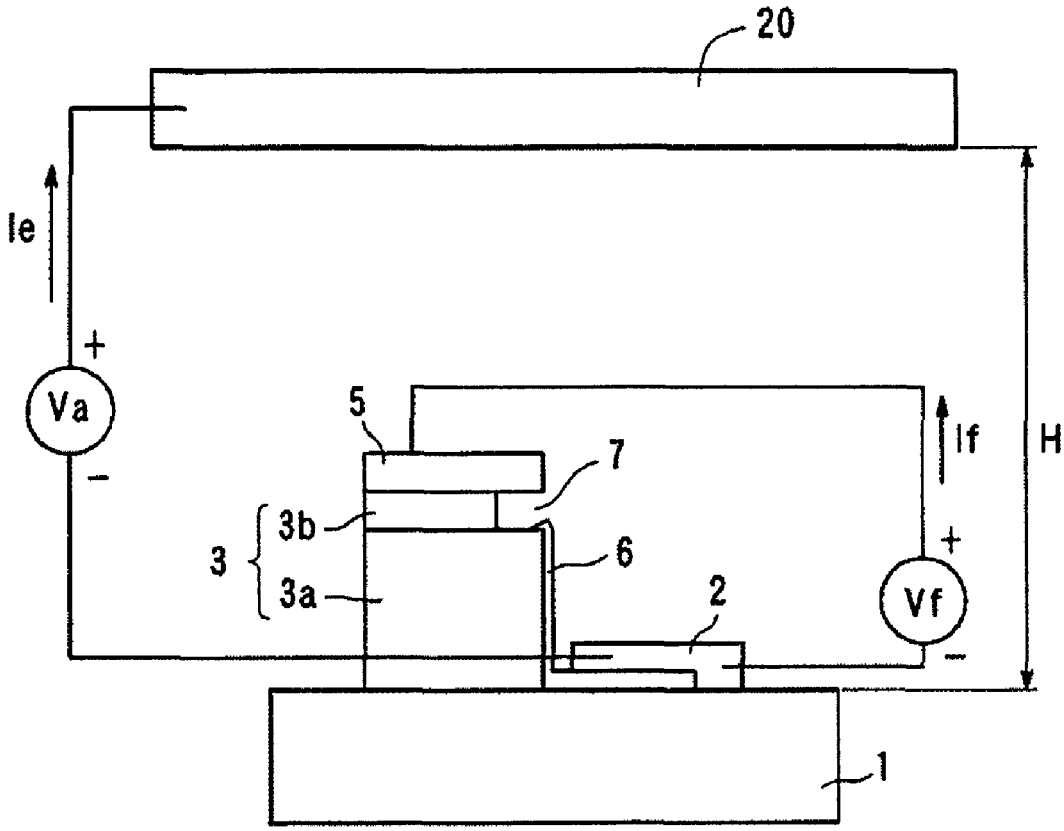
FIG. 3 is a schematic diagram illustrating a supply arrangement of a power supply in measuring an electron emission characteristic of the element of the embodiment.

FIG. 3 illustrates a supply arrangement of a power supply in measuring an electron emission characteristic of the element of the embodiment. As illustrated in FIG. 3, in the electron beam apparatus of the embodiment, the anode 20 is disposed opposite the projection portion of the cathode 6 while the gate 5 is interposed therebetween. In the embodiment, because the insulating member 3 is disposed on the substrate 1, the anode 20 is disposed opposite the substrate 1 on the side on which the insulating member 3 of the substrate 1 is disposed.

Referring to FIG. 3, a voltage Vf is applied between the gate 5 and the cathode 6 of the element, a current If is passed at that time, a voltage Va is applied between the cathode 6 and the anode 20, and an electron emission current Ie is passed. At this point, generally electron emission efficiency $\eta$ is given by efficiency $\eta$=Ie/(If+Ie) using the current If detected in applying the voltage to the element and the current Ie taken out into vacuum.

Figure 2A:
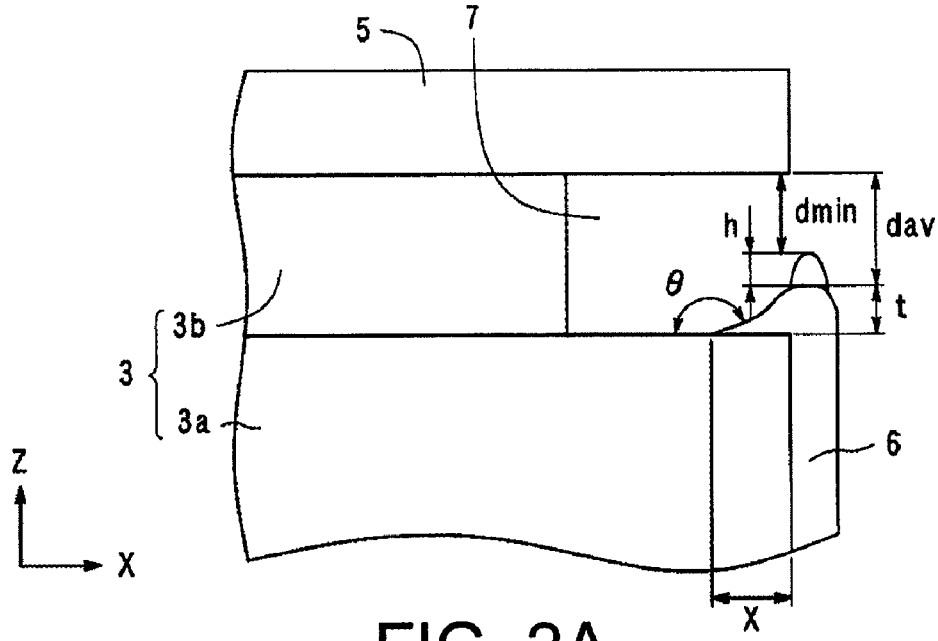
FIGS. 2A and 2B are enlarged views illustrating a projection portion of a cathode in the element of FIG. 1.
Figure 2B:
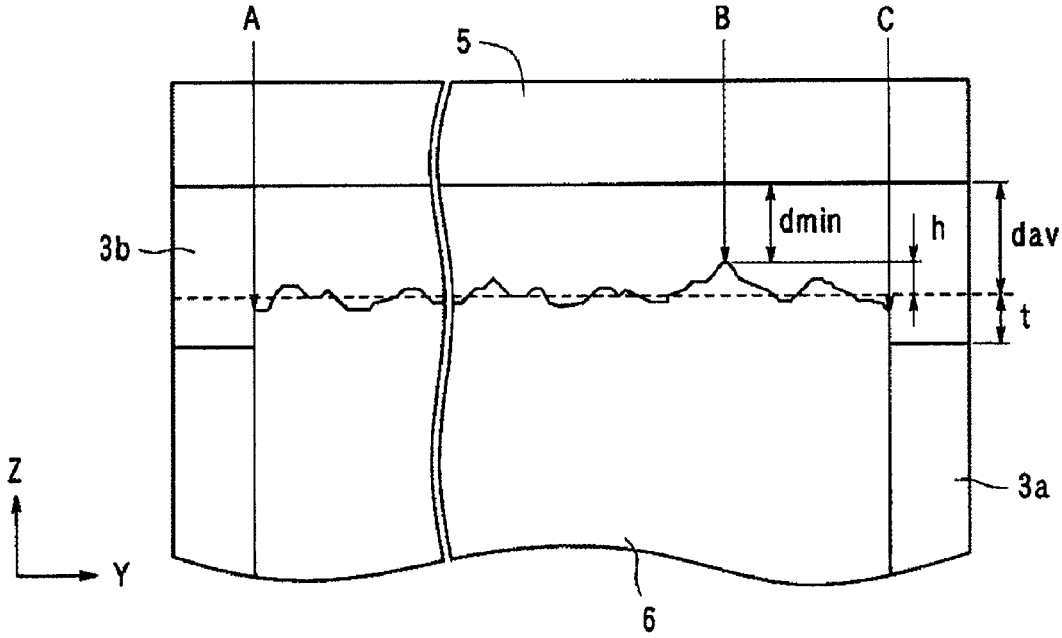

FIGS. 2A and 2B are enlarged views of the projection portion of the cathode 6 of FIGS. 1B and 1C. As illustrated in FIG. 2, the electron emission element of the embodiment includes the projection portion that is projected from the edge of the recess 7 toward the gate 5 on the side on which the cathode 6 is located across the recess 7 from the gate 5. That is, in the projection portion, the cathode 6 is opposite the gate 5 with the gap 8 interposed therebetween. Because an electric-field doubling effect on the cathode 6 is generated by the projection shape of the cathode 6, the electron emission can be performed by electric field intensity lower than that of the flat cathode.

As illustrated in FIG. 2, in the electron emission element of the embodiment, the projection portion of the cathode 6 has a height distribution in a direction in which the insulating member 3 and the gate 5 are laminated, that is, a Z-direction. Therefore, a shortest distance d between the projection portion and the gate 5 also has a distribution. At this point, it is assumed that dav (m) is an average value of the shortest distance d between the projection portion of the cathode 6 and the gate 5 in the Z-direction. It is also assumed that a difference h (m) between the average value dav and a shortest distance dmin from the cathode 6 to the highest convex portion of the projection portion of the gate 5. Hereinafter the difference h is referred to as a convex height. In the embodiment, the average value dav and the convex height h satisfies the following relationship (expression 1).

$$h/dav<0.39$$

The expression will be described in detail.

Values T1, T3, T4, and T5 of FIG. 1 are set to 20 nm, 500 nm, 1000 nm, and 8000 nm, respectively, and a value T2 of FIG. 1 and a value t of FIG. 2 are changed to prepare the electron emission elements having the different shortest distances between the projection portion of the cathode 6 and the gate 5. The electron emission element having the maximum convex height h is prepared by changing the condition to form the cathode 6.

Figure 4A:
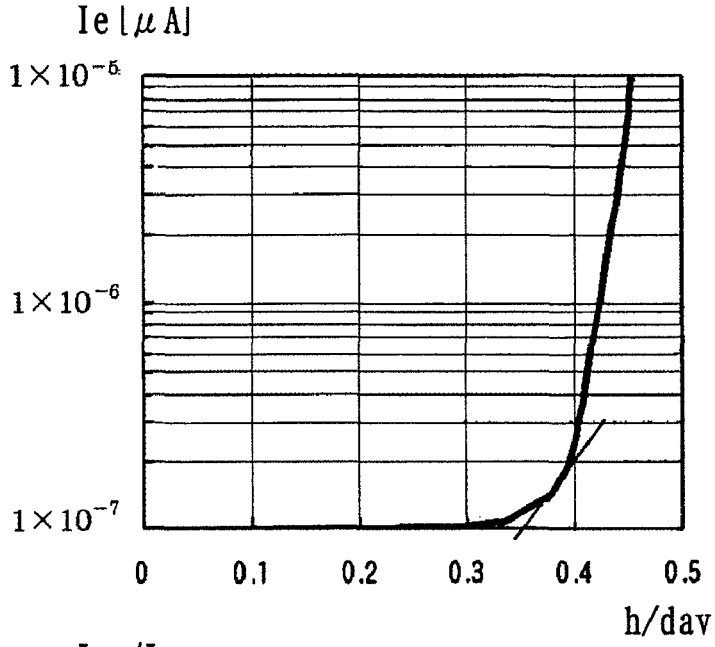
FIGS. 4A and 4B illustrate a relationship between a gate-cathode distance and an electron emission amount.

FIG. 4A illustrates a result in which the voltages Vf and Va are applied to the obtained element to measure the emission current Ie. The voltage Vf is adjusted in each electron emission element such that an evaluated value of the emission current Ie computed from a Fauler-Nordheim equation (FN equation) becomes $1\times10^{-7}$ (A) based on the electric field intensity evaluated from the average value dav of the shortest distance between the projection portion of the cathode 6 and the gate 5. In FIG. 4A, a horizontal axis indicates a ratio h/dav of the electron emission elements and a vertical axis indicates the emission current Ie. When the ratio h/dav becomes 0.39 or more, the emission current Ie rapidly increases. It is found that a threshold at which the emission current Ie rapidly increases is determined by the ratio h/dav irrespective of the average value dav and the convex height h.

Figure 4B:
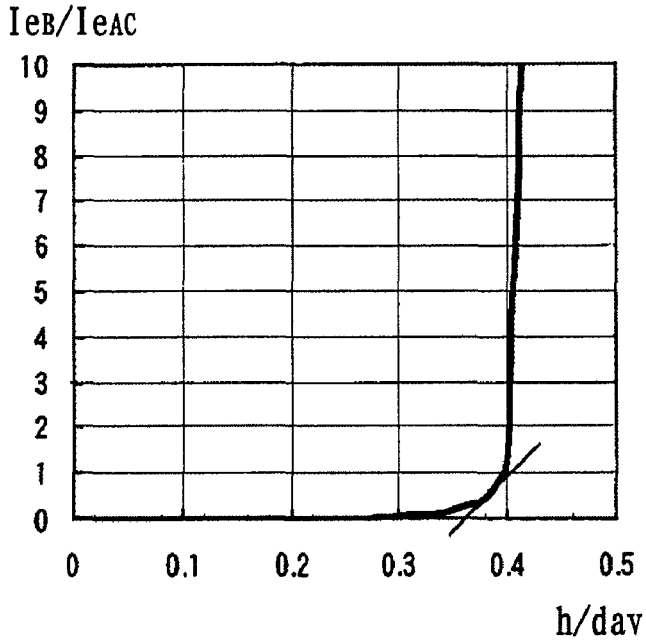

The gap 8 (electron emission portion) between the projection portion of the cathode 6 and the gate 5 in the electron emission element is enlarged with a microscope, and a distribution in a Y-direction and emission intensity during the electron emission at each position in the Y-direction are measured with a CCD camera. Because the emission intensity is proportional to the emission current amount, the current amount can be quantitatively obtained at each position in the Y-direction. As a result of the measurement, depending on the ratio h/dav, sometimes the electron emission is confirmed only from a point C of an edge portion of FIG. 2B, and sometimes the electron emission is confirmed from any point between the points A and C in addition to the points A and C. It is assumed that a point B is an electron emission point when the electron is emitted from any point between the points A and C. FIG. 4B illustrates a relationship between the ratio h/dav and a ratio $Ie_B/Ie_{AC}$ of the sum of emission currents $Ie_{AC}$ at the points A and C of the edge portion and an emission current $Ie_B$ from any point B in the internal region when the voltages Vf and Va are applied similarly to the result of FIG. 4A. As can be seen from FIG. 4B, a threshold at which the ratio $Ie_B/Ie_{AC}$ rapidly increases exists in the ratio h/dav, and the threshold is matched with the threshold of FIG. 4A at which the emission current Ie rapidly increases.

The reason why the emission current Ie is changed by the ratio h/dav is as follows.

When the average value dav of the shortest distance between the projection portion of the cathode 6 and the gate 5 is sufficiently wide with respect to the maximum convex height h of the projection portion of the cathode 6, the electric field intensity becomes larger at the points A and C of FIG. 2B, and an electron emission amount of the whole element is determined by electron emission amounts at the points A and C. On the other hand, when the average value dav becomes smaller with respect to the convex height h, because a distance between a leading end of the projection and the gate 5 is narrowed, the electric field intensity of the convex portion (that is, point B) becomes larger than those of the points A and C. When the ratio h/dav of the expression (1) becomes 0.39 or more, the electron emission amount of the convex portion cannot be ignored, and the emission current amount Ie increases.

That the electron emission amount increases rapidly by the ratio h/dav means that the electron emission amount is largely changed only by slightly changing the ratio h/dav for reasons of production. That is, a variation in electron emission amount is generated even if the ratio h/dav is controlled on the similar preparing conditions. The variation in electron emission amount leads to an excess current passed through the element, which possibly results in breakage of the electron emission element. In the electron source substrate in which the plural electron emission elements are arranged, the uniform image cannot be provided by the variation in electron emission amount.

In summary, in order to restrict the variation in electron emission amount at one emission point, it is necessary to prepare the electron emission element having the element structure satisfying the condition of h/dav<0.39. As a result, the electron emission element in which the electron emission amount is controlled is obtained to prevent the element breakage, and the image display apparatus that prevents the variation to display the uniform image can be provided.

In the electron emission element of FIGS. 1 and 2, the length T4 in the direction (Y-direction) along the recess 7 in the projection portion of the cathode 6 is shorter than the length T5 in the direction of the portion corresponding to the projection portion of gate 5. The reason why the configuration of the embodiment is suitable will be described below.

Figure 5:
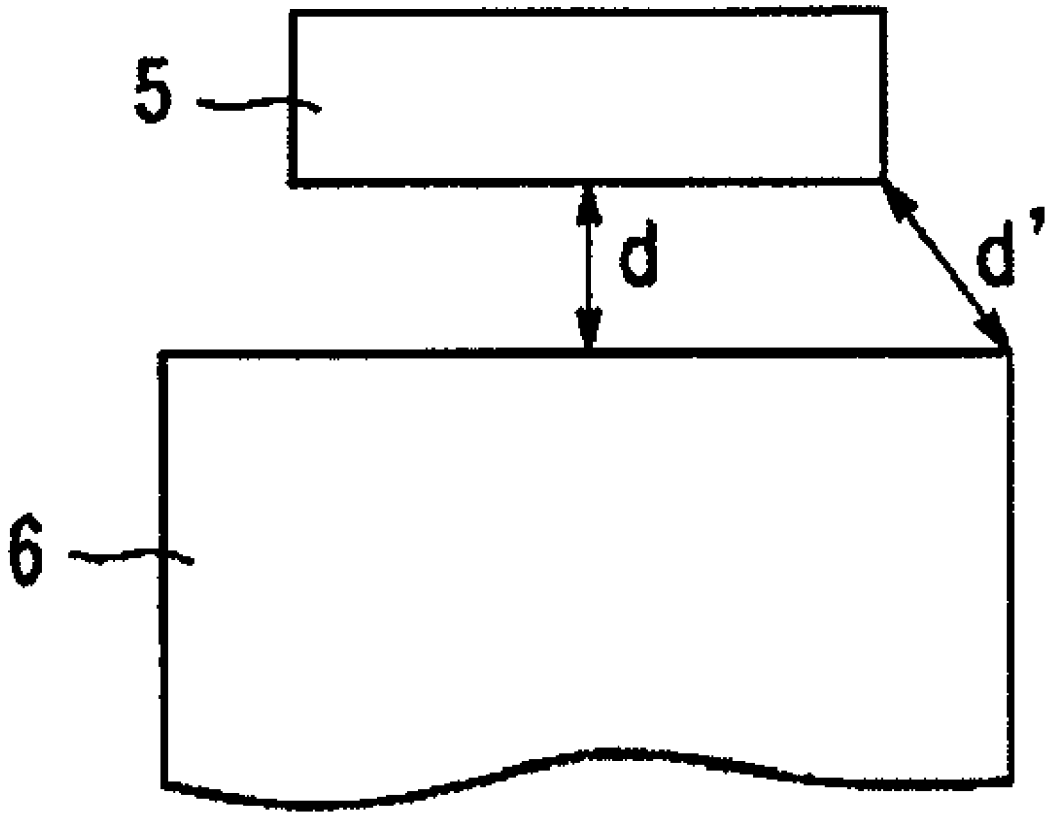
FIG. 5 is a schematic diagram illustrating a configuration in which the projection portion of the cathode is longer than the opposite gate in the electron emission element of the embodiment.

When the gate width T5 is shorter than the cathode width T4, a distance d' between the gate 5 and an edge of the projection portion of the cathode 6 becomes larger than a distance d between the gate 5 and a central portion of the projection portion as illustrated in FIG. 5, thereby lowering the electric field intensity at the edge of the projection portion of the cathode 6. When the gap between the gate 5 and the cathode 6 is narrowed in order to compensate the lowering of the electric field intensity, it is necessary to control more strictly the convex height h in order to control the electron emission amount of one element. Therefore, desirably the gate width T5 becomes larger than the cathode width T4 in order to control the current amount of one element by a simple production method.

In the electron emission element of FIG. 2, the projection portion of the cathode 6 is formed in both an outer surface of the insulating member 3 and an inner surface of the recess 7. That is, the projection portion of the cathode 6 invades into the inner surface from the edge of the recess 7 with a distance X. The following effects (1) to (3) are obtained in the configuration of FIG. 2.

(1) The projection portion of the cathode 6 that constitutes the electron emission portion is widely in contact with the insulating member 3 to improve mechanical contact force.

(2) A thermal contact area between the insulating member 3 and the projection portion of the cathode 6 that constitutes the electron emission portion is widened to be able to efficiently transfer heat generated in the electron emission portion to the insulating member 3.

(3) The projection portion invades into the recess 7 with a gentle gradient to weaken the electric field intensity at a triple junction generated at an insulating layer-vacuum-metal interface, and a discharge phenomenon caused by the generation of abnormal electric field can be prevented. The distance X is a distance to the edge of the recess 7 from an end of the portion that comes into contact with the inner surface of the recess 7 in the projection portion.

The increase in distance X in which the projection portion of the cathode 6 invades into the recess 7 is not always a good thing. The distance X can be controlled by controlling an angle in depositing the projection portion material of the cathode 6 that constitutes the electron emission portion, the thickness T2 of the insulating layer 3*b* in which the recess 7 is formed, and the thickness T1 of the gate 5. Desirably the distance X is longer than 20 nm.

However, when the distance X is excessively long, leakage is generated between the cathode 6 and the gate 5 through the inner surface (side face of the insulating layer 3*b*) of the recess 7 to increase a leak current. Generally the distance X is set to a range of about 10 to about 30 nm.

When three kinds of materials having different dielectric constants like vacuum, an insulating material, and metal come simultaneously into contact with one another at one position, the position is called the triple junction, and occasionally the electric field at the triple junction becomes extremely higher than that of the surround according to the condition to cause the discharge. When an angle θ at which the projection portion of the cathode 6 and the insulating layer 3*a* come into contact with each other is 90° or more, the electric field at the triple junction differs little from the electric field of the surround. However, for example, when the projection portion of the cathode 6 is peeled off from the upper surface of the insulating layer 3*a* by some sort of a lack of mechanical strength, the angle θ becomes 90° or less to form the strong electric field. At this point, because the strong electric field is formed at the interface at which the projection portion is peeled off, occasionally the element breakage is generated due to the electron emission from the triple junction or surface flashover triggered by the electron emission. Accordingly, in the embodiment, desirably the angle θ at which the projection portion of the cathode 6 and the insulating layer 3*a* come into contact with each other is 90° or more. Generally the angle θ is set to a range of about 100° to about 170°.

A method for producing the electron emission element of the embodiment will be described with reference to FIG. 6.

The substrate 1 is an insulating substrate that mechanically supports the element, and is made of quartz glass, glass in which a content of an impurity such as Na is reduced, blue glass, or silicon. Functions necessary for the substrate include high mechanical strength and a resistant property to alkali or acid such as dry etching, wet etching, and a developer. When the substrate is integrally used like a display panel, desirably the substrate has a small thermal expansion with the deposition material or other laminated members. Desirably the substrate is made of a material in which an alkali element hardly diffuses from the inside of the glass by a heat treatment.

Figure 6A:
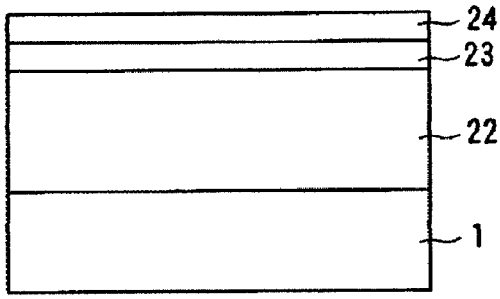
FIGS. 6A-6G illustrate an example of a process for producing the electron emission element of the embodiment.

At first, as illustrated in FIG. 6A, an insulating layer 22 that constitutes the insulating layer 3*a*, an insulating layer 23 that constitutes the insulating layer 3*b*, and a conductive layer 24 that constitutes the gate 5 are laminated on the substrate. The insulating layers 22 and 23 are insulating films that are made of materials having excellent workability. For example, the insulating layers 22 and 23 are made of SiN ($Si_xN_y$) or $SiO_2$ and formed by a CVD method, a vacuum plating method, and a general vacuum deposition method such as a sputtering method. A thickness of the insulating layer 22 is set to a range of several nanometers to tens micrometers, and preferably the thickness is selected in a range of tens nanometers to hundreds nanometers. A thickness of the insulating layer 22 is set to a range of several nanometers to hundreds nanometers, and preferably the thickness is selected in a range of several nanometers to tens nanometers. It is necessary to form the recess 7 after the insulating layers 22 and 23 are laminated. Therefore, it is necessary to set a relationship between the insulating layer 22 and the insulating layer 23 such that the insulating layer 22 and the insulating layer 23 have different etching amounts to the etching. Desirably a ratio of etching amounts of the insulating layer 22 and the insulating layer 23 is 10 or more, more desirably the ratio is 50 or more. For example, the insulating layer 22 is made of $Si_xN_y$, and the insulating layer 23 is made of an insulating material such as $SiO_2$ or PSG having a high phosphorous concentration, or BSG having a high boron concentration.

The conductive layer 24 is formed by general vacuum deposition techniques such as the evaporating method and the sputtering method. Desirably the material for the conductive layer 24 has high thermal conductivity and a high melting point in addition to a conductive property. For example, metals such as Be, Mg, Ti, Zr, Hf, V, Nb, Ta, Mo, W, Al, Cu, Ni, Cr, Au, Pt, and Pd or alloy materials can be used as the conductive layer 24. Carbides such as TiC, ZrC, HfC, TaC, SiC, and WC, borides such as $HfB_2$, $ZrB_2$, $CeB_6$, $YB_4$, and $GdB_4$, nitrides such as TiN, ZrN, HfN, and TaN, and semiconductors such as Si and Ge can also be used as the conductive layer 24. An organic polymer material, amorphous carbon, graphite, diamond-like carbon, and carbon and carbon compound in which diamond is dispersed can appropriately be used as the conductive layer 24. A thickness of the conductive layer 24 is set to a range of several nanometers to hundreds nanometers, and preferably the thickness is selected in a range of tens nanometers to hundreds nanometers.

Figure 6B:
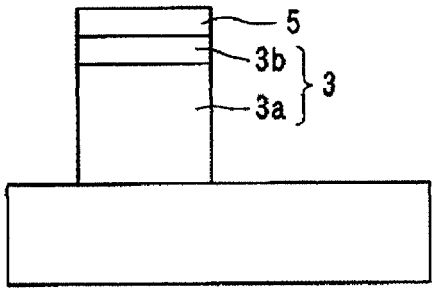

After a resist pattern is formed on the conductive layer 24 by a photolithographic technique, the conductive layer 24 and the insulating layers 23 and 22 are sequentially processed by an etching technique to obtain the gate 5 and the insulating layers 3*b* and 3*a* as illustrated in FIG. 6B. Generally, RIE (Reactive Ion Etching) in which the material is precisely etched by irradiating the material with the plasma etching gas is used in the etching process. When a fluoride is formed as a target member to be processed, a fluorine system gas such as $CF_4$, $CHF_3$, and $SF_6$ is selected as the processing gas. When chloride such as silicon or aluminum is formed, a chlorine system gas such as $Cl_2$ and $BCl_3$ is selected. In order to take a selection ratio of the resist, hydrogen, oxygen, or argon gas is added as needed to secure smoothness of an etching surface or enhance an etching rate.

Figure 6C:
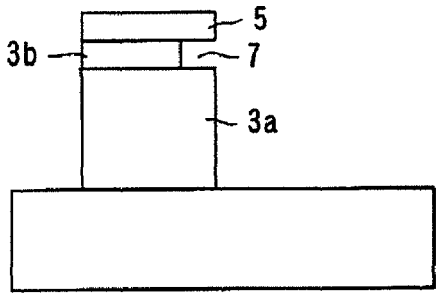

As illustrated in FIG. 6C, the insulating layer 3*b* is etched to form the recess 7 in the surface of the insulating member 3 including the insulating layers 3*a* and 3*b*. When the insulating layer 3*b* is made of $SiO_2$, a mixed solution called buffered hydrofluoric acid (BHF) in which ammonium fluoride and hydrofluoric acid are mixed can be used in the etching. When the insulating layer 3*b* is made of $Si_xN_y$, a hot phosphoric acid system etching solution can be used in the etching. A depth (a distance from the outer surface (the side face of the insulating layer 3*a*) of the insulating member 3 to the side face of the insulating layer 3*b*) of the recess 7 is deeply involved in a leak current after the element formation, and a value of the leak current decreases as the recess 7 is formed deeper. However, an issue such as the deformed gate is generated when the recess 7 is formed excessively deep. Therefore, the depth of the recess 7 is formed in a range of about 30 nm to about 200 nm. In the embodiment, the insulating member 3 is formed by the laminated body of the insulating layers 3*a* and 3*b*. However, the invention is not limited to the laminated body of the insulating layers 3*a* and 3*b*. For example, the recess 7 may be formed by removing part of the single insulating layer.

Figure 6D:
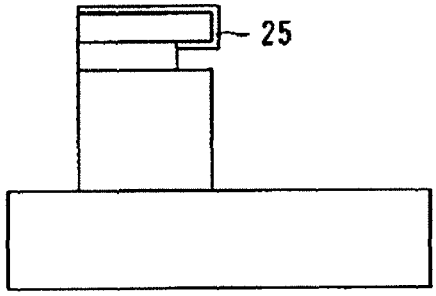

As illustrated in FIG. 6D, a peel-off layer 25 is formed in the gate 5. The peel-off layer 25 is formed in order to peel off a cathode material 26 deposited in the next process from the gate 5. Therefore, the peel-off layer 25 is formed by a method for oxidizing the gate 5 to form an oxide film or a method for depositing peel-off metal by electrolytic plating.

Figure 6E:
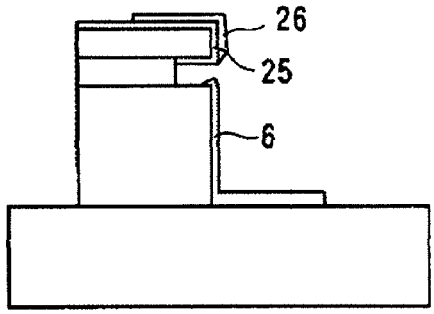

As illustrated in FIG. 6E, the cathode material 26 is deposited on the gate 5, part of the outer surface of the insulating member 3 (outer surface (side face) of the insulating layer 3*a*), and the inner surface (the upper surface of the insulating layer 3*a*) of the recess 7. The cathode material 26 is made of a conductive material that performs field emission. Generally the material have a high melting point of 2000° C. or more and a work function of 5 eV, and preferably a chemical reaction layer such as oxide is hardly formed or the chemical reaction layer can easily be removed in the material. For example, metals such as Hf, V, Nb, Ta, Mo, W, Au, Pt, and Pd and alloy materials can be used as the material. Carbides such as TiC, ZrC, HfC, TaC, SiC, and WC, borides such as $HfB_2$, $ZrB_2$, $CeB_6$, $YB_4$, and $GdB_4$, and nitrides such as TiN, ZrN, HfN, and TaN can also be used as the material. Amorphous carbon, graphite, diamond-like carbon, and carbon and carbon compound in which diamond is dispersed can appropriately be used as the material. The cathode material 26 is formed by general vacuum deposition techniques such as the evaporating method and the sputtering method.

In the embodiment, in order to keep the electron emission amount constant, it is necessary to control the ratio h/dav to satisfy $h/dav<0.39$. A method for controlling the convex height h will be described below.

Figure 7A:
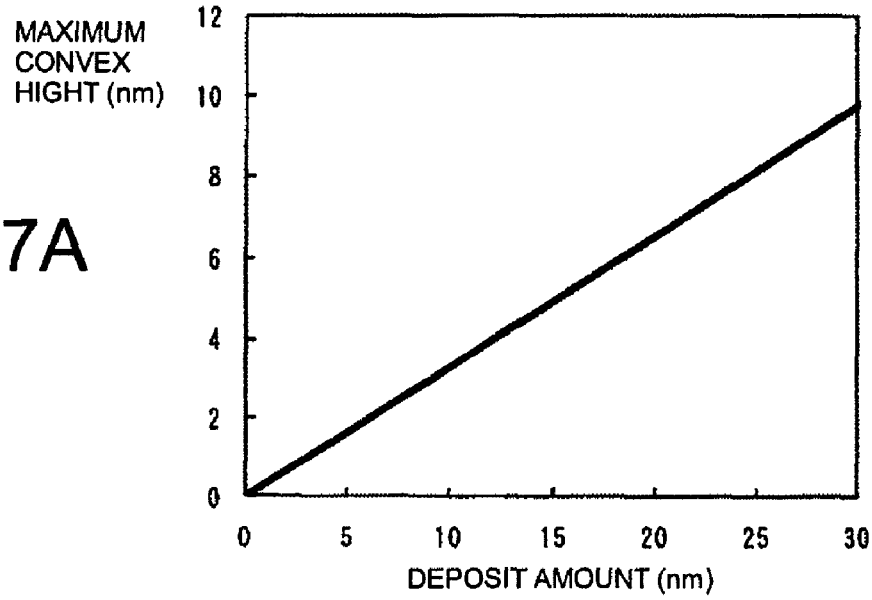
FIGS. 7A and 7B illustrate a relationship between a convex height of the projection portion of the cathode and a cathode forming condition.
Figure 7B:
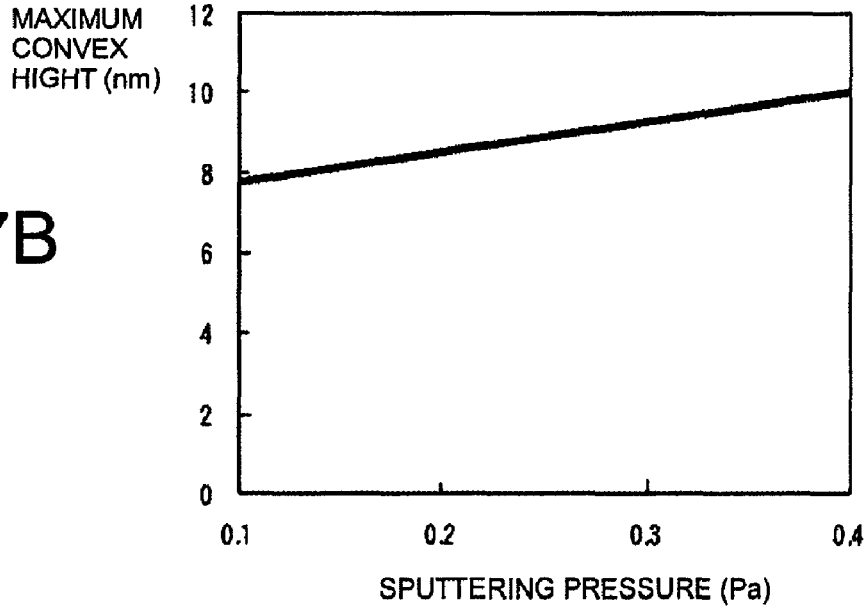

FIG. 7A illustrates a relationship between the convex height h and a film thickness in forming Mo that is of the cathode material. The convex height h increases by thickening the Mo film. That is, the convex height h can be controlled by controlling the Mo thickness. When Mo is formed by the sputtering method, the Mo thickness can mainly be controlled by a partial pressure of discharge gas, a deposition time, and DC power. FIG. 7B illustrates a relationship between the convex height h and a sputtering pressure during the deposition. The pressure during the sputtering is reduced, and then the convex height h is also reduced. That is, the convex height h can be controlled by the pressure during the sputtering.

As described above, in the embodiment, in order to efficiently take out the electrons, it is necessary to prepare the Mo film by controlling the deposition angle, the deposition time, the temperature during the deposition, and a vacuum level during the deposition such that the projection portion of the cathode 6 becomes the optimum shape.

Figure 6F:
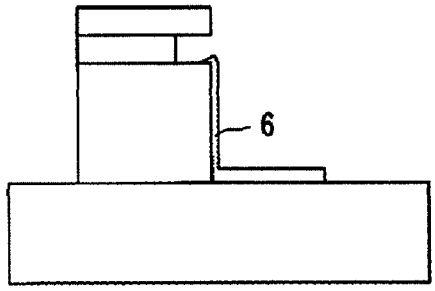
Figure 6G:
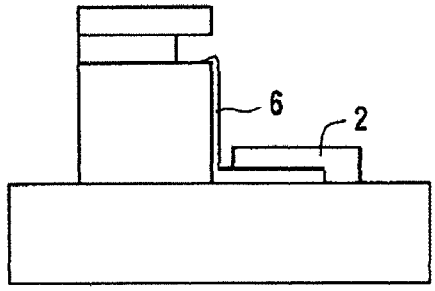

As illustrated in FIG. 6F, the peel-off layer 25 is removed by the etching to remove the cathode material 26 on the gate 5. As illustrated in FIG. 6G, the electrode 2 is formed in order to establish electric conduction to the cathode 6. The electrode 2 has the conductivity like the cathode 6 and is formed by general vacuum deposition techniques such as the evaporation method and the sputtering method and the photolithographic technique. For example, metals such as Be, Mg, Ti, Zr, Hf, V, Nb, Ta, Mo, W, Al, Cu, Ni, Cr, Au, Pt, and Pd and alloy materials can be used as the material for the electrode 2.

Carbides such as TiC, ZrC, HfC, TaC, SiC, and WC, borides such as $HfB_2$, $ZrB_2$, $CeB_6$, $YB_4$, and $GdB_4$, and nitrides such as TiN, ZrN, and HfN can also be used as the material for the electrode 2. Semiconductors such as Si and Ge, an organic polymer material , amorphous carbon, graphite, diamond-like carbon, and carbon and carbon compound in which diamond is dispersed can appropriately be used as the material for the electrode 2. A thickness of the electrode 2 is set to a range of tens nanometers to several millimeters, and preferably the thickness is selected in a range of tens nanometers to several micrometers.

The electrode 2 and the gate 5 may be made of the same material or different materials by the same forming method or different forming methods. However, desirably the gate 5 is made of a low-resistance material because the thickness of the gate 5 is occasionally set thinner than that of the electrode 2.

Figure 8A:
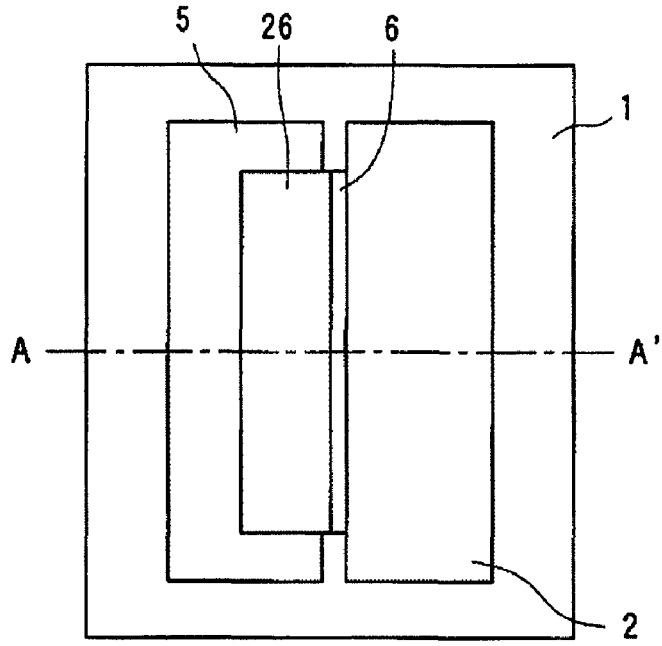
FIGS. 8A-8C illustrate another example of the configuration of the electron emission element of the embodiment.
Figure 8B:
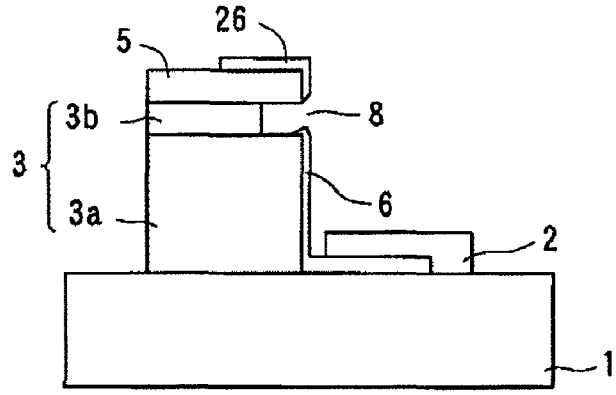
Figure 8C:
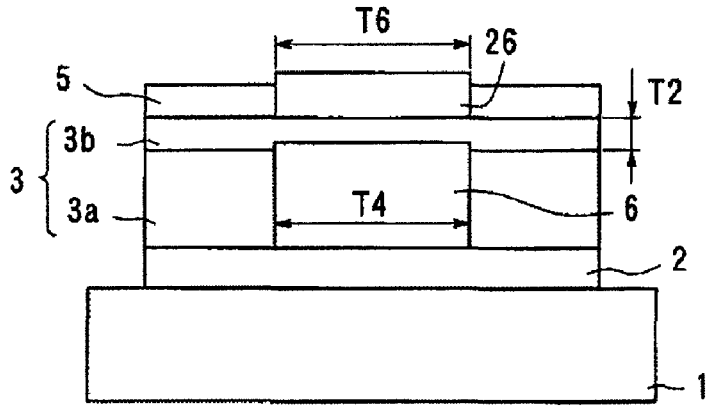

FIG. 8 illustrates an example in which the gate 5 includes an overhang portion in the portion opposite the cathode 6 in the electron emission element of the embodiment. FIG. 8A is a plan view schematically illustrating a configuration of the electron emission element of the example, and FIG. 8B is a schematic sectional view taken on a line of A-A' of FIG. 8A. FIG. 8C is a side view of the electron emission element in FIG. 8A, when the element is viewed from the right. In FIG. 8, an overhang portion is provided in the gate 5.

In FIG. 8, electrons generated from the cathode 6 collide with the opposite gate 5 and overhang portion 26, and the electrons are partially taken out to the outside without collision. Many collided electrons are isotropically scattered by the overhang portion 26. At this point, it is analytically found that the electron emission efficiency is enhanced by setting the relationship between the width T4 of the cathode 6 and a width T6 of the overhang portion 26 to T4 ≧T6 (T6 is set equal to or lower than T4). Preferably, the electron emission efficiency is particularly enhanced when a difference between the widths T4 and T6 becomes at least double the height T2 of the insulating layer 3*b*.

Figure 9:
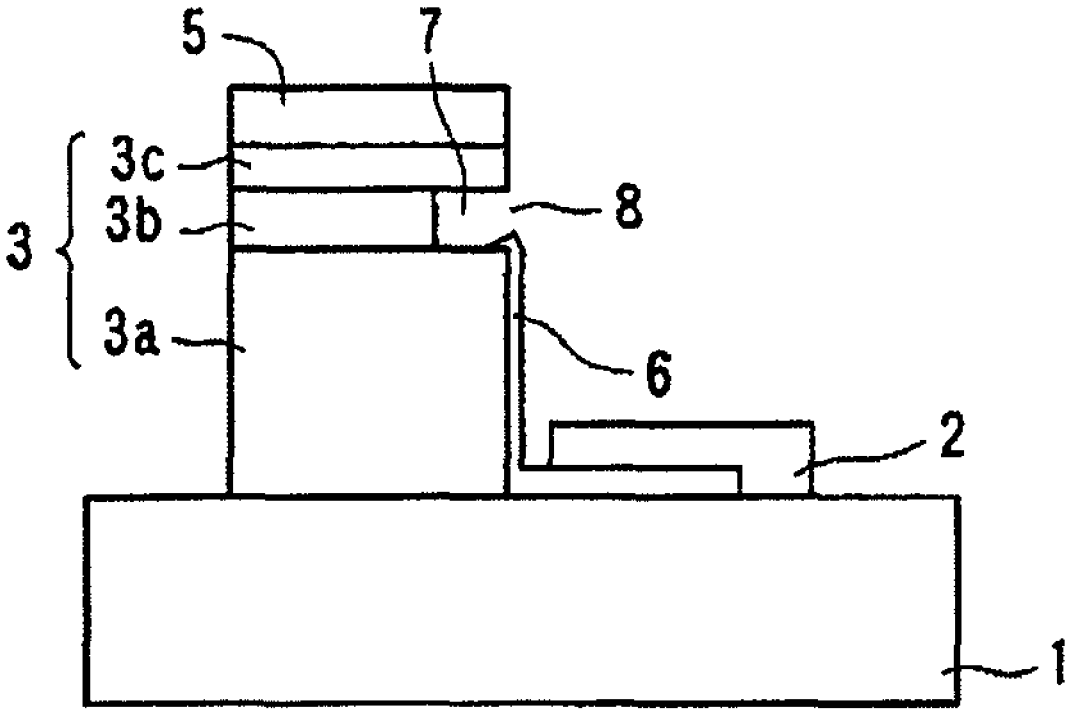
FIG. 9 illustrates another example of the configuration of the electron emission element of the embodiment.

In the electron emission element of the embodiment, the insulating member 3 includes the insulating layers 3*a* and 3*b*, and the lower surface of the gate 5 is exposed to the recess 7. Alternatively, in the gate 5, the portion opposite the recess 7 (in the example, the surface exposed to the recess 7) may be covered with the insulating layer 3*c* as illustrated in FIG. 9. In the element of FIG. 1, in the electrons emitted from the cathode 6, electrons that collide with the bottom surface (surface exposed to the recess 7) of the gate 5 does not reach the anode 20, but the electrons that collide with the bottom surface become a factor (If component) that reduces the electron emission efficiency. However, in the configuration in which the lower surface of the gate 5 is covered with the insulating layer 3*c* as illustrated in FIG. 9, the If component can be reduced to enhance the electron emission efficiency. For example, a SiN film having a thickness of about 20 nm can be used as the insulating layer 3*c* with which the lower surface of the gate 5 is covered, and it is confirmed that the efficiency enhancing effect is sufficiently obtained by the SiN film having a thickness of about 20 nm.

In the configuration of FIG. 9, the insulating member 3 is formed by the laminated body including the insulating layers 3*a*, 3*b*, and 3*c*. Alternatively, the recess 7 may be formed by partially removing the single insulating layer.

In the invention, the configuration of FIG. 8 can be combined with the configuration of FIG. 9, the similar condition is set in each configuration and the similar effect is obtained.

Figure 10:
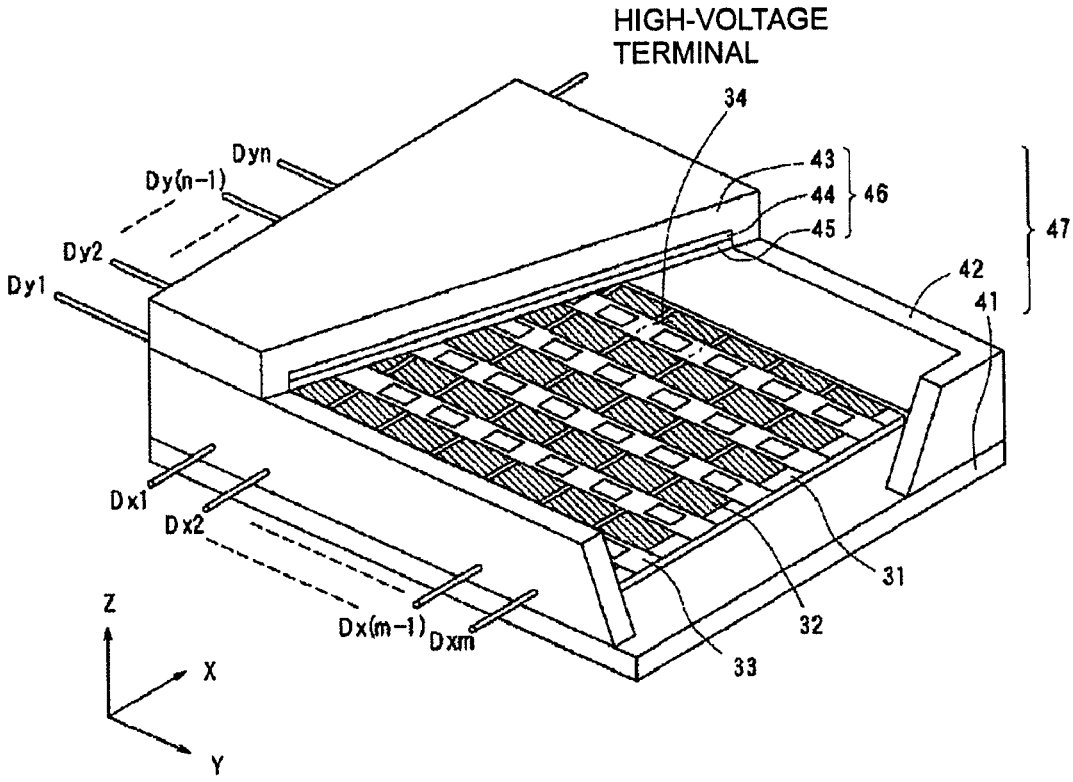
FIG. 10 is a perspective view illustrating a configuration of a display panel of an image display apparatus according to an embodiment of the invention.

An image display apparatus including an electron source substrate that is obtained by providing the plural electron emission elements of the embodiment are arranged will be described with reference to FIG. 10. FIG. 10 is a schematic diagram illustrating an example of a display panel of the image display apparatus formed with simple matrix electron sources, and FIG. 10 illustrates a partially cutaway state.

Referring to FIG. 10, the numeral 31 designates an electron source substrate, the numeral 32 designates an X-direction interconnection, and the numeral 33 designates a Y-direction interconnection. The electron source substrate 31 corresponds to the substrate 1 of the electron emission element. The numeral 34 designates the electron emission element of the embodiment. The X-direction interconnection 32 is an interconnection in which the electrodes 2 are commonly connected, and the Y-direction interconnection 33 is an interconnection in which the gates 5 are commonly connected.

The m pieces of the X-direction interconnections 32 includes interconnections Dx1, Dx2, . . . , and Dxm and can be made of conductive metal formed by the vacuum evaporating method, a printing method, and the sputtering method. The material, film thickness, and width of the interconnection are appropriately designed. The n pieces of the-direction interconnections 33 includes interconnections Dy1, Dy2, . . . , and Dyn and formed in the manner similar to that of the X-direction interconnections 32. An interlayer insulator (not illustrated) is provided between the m pieces of the X-direction interconnections 32 and the n pieces of the-direction interconnections 33 to electrically separate the m pieces of the X-direction interconnections 32 and the n pieces of the-direction interconnections 33 (m and n are positive integers).

The interlayer insulator (not illustrated) is made of $SiO_2$ formed by the vacuum evaporating method, the printing method, and the sputtering method. For example, the interlayer insulator is formed into a desired shape in the whole surface or part of the electron source substrate 31 in which the X-direction interconnections 32 are formed, and the film thickness, material, and producing method of the interlayer insulator are appropriately set so as to withstand a potential difference between the X-direction interconnection 32 and the Y-direction interconnection 33 in an intersection portion. The X-direction interconnection 32 and the Y-direction interconnection 33 are led out as external terminals. The electrode 2 and the gate 5 (see FIG. 1) are electrically connected by the connection including the m pieces of the X-direction interconnections 32, the n pieces of the-direction interconnections 33, and the conductive metal. The material constituting the interconnection 32 and interconnection 33, the material constituting the connection, and the material constituting the electrode 2, and the material constituting the gate 5 may partially or wholly be formed by the same material or different materials.

A scanning signal applying unit (not illustrated) is connected to the X-direction interconnections 32 in order to apply a scanning signal to select a row of the electron emission elements 34 arrayed in the X-direction. On the other hand, a modulation signal generation unit (not illustrated) is connected to the Y-direction interconnections 33 in order to modulate each column of the electron emission elements 34 arrayed in the Y-direction according to an input signal. A driving voltage applied to each electron emission element is supplied as a voltage difference between the scanning signal and the modulation signal, which are applied to the element.

In the above described configuration, the individual element can be selected and driven using the simple matrix interconnection.

Referring to FIG. 10, the electron source substrate 31 is fixed to a rear plate 41, and a fluorescent film 44 made of a fluorescent material that is of a light emission member and a metal back 45 that is of the anode 20 are formed in an inner surface of a glass substrate 43 of a face plate 46. The rear plate 41 and the face plate 46 are mounted to a support frame 42 with frit glass interposed therebetween, thereby forming a chassis 47. The sealing with the frit glass is performed by burning for at least 10 minutes at a temperature range of 400 to 500° C. in air or nitrogen.

As described above, the chassis 47 includes the face plate 46, the support frame 42, and the rear plate 41. Because the rear plate 41 is provided in order to mainly reinforce the electron source substrate 31, the separate rear plate 41 can be eliminated when the electron source substrate 31 has the sufficient strength. That is, the support frame 42 is directly sealed to the electron source substrate 31, and the chassis 47 may include the face plate 46, the support frame 42, and the electron source substrate 31. Alternatively, the sufficient strength can be secured to the atmospheric pressure by providing a support body (not illustrated) called spacer between the face plate 46 and the rear plate 41.

In the image display apparatus, in consideration of an orbit of the emitted electron, the fluorescent material is aligned in an upper portion of each electron emission element 34. When the fluorescent film 44 of FIG. 10 is formed by a color fluorescent film, the fluorescent film 44 may include a black conductive material called black stripe or black matrix and the fluorescent material.

A configuration example of a driving circuit that performs television display based on an NTSC television signal on the display panel formed using the simple matrix electron source will be described below.

The display panel is connected to an external electric circuit through the terminals Dx1 to Dxm, the terminals Dy1 to Dyn, and a high-voltage terminal. The scanning signal is applied to the terminals Dx1 to Dxm in order to sequentially drive the electron sources provided in the display panel, that is, the m-by-n matrix electron emission element group one by one. On the other hand, the modulation signal is applied to the terminals Dy1 to Dyn in order to control the output electron beam of each element of the one-line electron emission element selected by the scanning signal. For example, a DC voltage source supplies a DC voltage of 10 kV to the high-voltage terminal, and the DC voltage of 10 kV is an acceleration voltage that provides energy enough to excite the fluorescent material to the electron beam emitted from the electron emission element.

As described above, the scanning signal, the emitted electron is accelerated by the modulation signal, and the high-voltage application to the anode, and the fluorescent material is irradiated with the electrons, thereby realizing the image display.

When the image display apparatus is formed using the electron emission elements of the embodiment, the image display apparatus having the shaped electron beam can be formed, and therefore the image display apparatus having the good display characteristic can be provided.

EXAMPLES

Comparative Example 1

The electron emission element having the configuration of FIG. 1 was prepared according to the process of FIG. 6.

PD200 that is of low-sodium glass developed for the plasma display was used as the substrate 1, and the insulating layer 22 made of SiN ($Si_xN_y$) was formed with the thickness of 500 nm by the sputtering method. Then the $SiO_2$ layer having the thickness of 49 nm was formed as the insulating layer 23 by the sputtering method. Then TaN having the thickness of 30 nm was laminated as the conductive layer 24 on the insulating layer 23 by the sputtering method (FIG. 6A).

After the resist pattern was formed on the conductive layer 24 by the photolithographic technique, the conductive layer 24, the insulating layer 23, and the insulating layer 22 were sequentially processed by the dry etching technique to form the gate 5 and the insulating member 3 including the insulating layers 3*a* and 3*b* (FIG. 6B). At this point, the $CF_4$ system gas was used because the materials that form the fluorides were selected as the insulating layers 22 and 23 and the conductive layer 24. As a result of RIE with the $CF_4$ system gas, after the etching, the angles of the insulating layers 3*a* and 3*b* and gate 5 were formed at about 80° with respect to the horizontal surface of the substrate 1. The width T5 of the gate 5 was set to 100 μm.

After the resist was peeled off, the side face of the insulating layer 3*b* is etched using BHF (hydrofluoric acid/ammonium fluoride aqueous solution) such that the depth becomes about 70 nm, and the recess 7 was formed in the insulating member 3 (FIG. 6C).

The electrolytic deposition of Ni was performed on the surface of the gate 5 by the electrolytic plating to form the peel-off layer 25 (FIG. 6D).

Molybdenum (Mo) that is of the cathode material 6 was deposited on the gate 5, the side face of the insulating member 3, and the surface of the substrate 1. In the comparative example, Mo was deposited by the sputtering method. In the sputtering method, the angle of the substrate 1 was set to 70° with respect to the horizontal surface. Therefore, Mo was incident to the upper portion of the gate 5 at the angle of 70°, and Mo was incident to the RIE-processed slope of the insulating member 3 at the angle of 30°. The pressure was set to 0.4 Pa during the sputtering such that the deposition rate became about 5 nm/min, and the deposition time of 4 minutes and 48 seconds was precisely controlled such that the thickness of Mo became 24 nm in the slope (FIG. 6E).

After the Mo film was formed, the Ni peel-off layer 25 deposited on the gate 5 was removed using an etching solution containing iodine and potassium iodide, thereby peeling off the Mo film on the gate 5.

The resist pattern was formed by the photolithographic technique such that the projection portion of the cathode 6 had the width T4 (FIG. 1) of 70 μm. Then the Mo film was processed on the substrate 1 and the side face of the insulating layer 3 by the dry etching technique to form the cathode 6. At this point, the $CF_4$ system gas was used because molybdenum that forms the fluorides was used as the cathode material 26.

As a result of analysis with a SEM (Scanning Electron Microscope), the average value dav was 22 nm in the shortest distance between the cathode 6 and the gate 5 and the maximum convex height h was 10 nm. That is, the ratio h/dav was 0.45.

Then Cu having the thickness of 500 nm was deposited by the sputtering method, and the patterning was performed to form the electrode 2.

After the element was formed in the above-described manner, the electron emission characteristic was evaluated with the configuration of FIG. 3. The electron emission element was driven by Vf=53.5 V and Va=1 kV, the electron emission portion was enlarged with the microscope, and the emission image is photographed with the CCD camera. Therefore, it was confirmed that the electron emission was generated from portions except the edge. Although the evaluated current value computed from the gap 8 between the gate 5 and the cathode 6 by the FN equation was 0.1 μA, the actual current was 11.8 μA.

Example 1

The electron emission element was prepared in the manner similar to that of the comparative example 1 except that the thickness of the insulating layer 23 was set to 47 nm, the Mo deposition rate was set to about 10 nm/min, the pressure during the sputtering was set to 0.1 Pa, and the deposition time of 2 minutes and 12 seconds was precisely controlled such that Mo had the thickness of 22 nm.

As a result of analysis with the SEM (Scanning Electron Microscope), the average value dav was 24 nm in the shortest distance between the cathode 6 and the gate 5 and the maximum convex height h was 8 nm. That is, the ratio h/dav was 0.33.

In the electron emission element of the example 1, the electron emission characteristic was evaluated with the configuration of FIG. 3. The electron emission element was driven by Vf=61.1 V and Va=1 kV, the electron emission portion was enlarged with the microscope, and the emission image is photographed with the CCD camera. Therefore, it was confirmed that the electron emission was generated only from the edge of the projection portion of the cathode 6. Although the evaluated current value computed from the gap 8 between the gate 5 and the cathode 6 by the FN equation was 0.1 μA, the actual current was 0.108 μA.

Example 2

The electron emission element was prepared in the manner similar to that of the comparative example 1 except that the thickness of the insulating layer 23 was set to 40 nm, the Mo deposition rate was set to about 10 nm/min, the pressure during the sputtering was set to 0.1 Pa, and the deposition time of 1 minute and 48 seconds was precisely controlled such that Mo had the thickness of 18 nm.

As a result of analysis with the SEM (Scanning Electron Microscope), the average value dav was 22 nm in the shortest distance between the cathode 6 and the gate 5 and the maximum convex height h was 6 nm. That is, the ratio h/dav was 0.27.

In the electron emission element of the example 2, the electron emission characteristic was evaluated with the configuration of FIG. 3. The electron emission element was driven by Vf=61.1 V and Va=1 kV, the electron emission portion was enlarged with the microscope, and the emission image is photographed with the CCD camera. Therefore, it was confirmed that the electron emission was generated only from the edge of the projection portion of the cathode 6. Although the evaluated current value computed from the gap 8 between the gate 5 and the cathode 6 by the FN equation was 0.1 μA, the actual current was 0.102 μA.

While the present invent ion has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-114382, filed on May 11, 2009, which is hereby incorporated by reference herein its entirety.

What is claimed is:

1. An electron beam apparatus comprising:

an insulating member that includes a recess in a surface thereof;

a gate that is located in the surface of the insulating member;

a cathode that includes a projection portion projected from an edge of the recess toward the gate, and being located in the surface of the insulating member so that the projection portion is opposite the gate; and an anode that is disposed opposite the projection portion with the gate interposed therebetween, wherein, in a direction in which the insulating member and the gate are laminated, the projection portion of the cathode has a height distribution, and an average value dav (m) of a shortest distance between the gate and the projection portion of the cathode, and a difference h (m) between the average value dav (m) and a shortest distance dmin (m) from the gate to a maximum convex portion of the projection portion of the cathode satisfy the following relationship:

$$h/dav<0.39.$$

2. The electron beam apparatus according to claim 1, wherein a length of the projection portion in a direction along the edge of the recess is shorter than a length of a portion of the gate opposite the projection portion in said direction.

3. The electron beam apparatus according to claim 2, wherein the gate includes an overhang portion in a portion opposite the projection portion of the cathode, and the length of the portion of the overhang portion opposite the projection portion in said direction is equal to or shorter than said length of the projection portion.

4. The electron beam apparatus according to claim 1, wherein a portion of the gate opposite the recess is covered with an insulating layer.

5. The electron beam apparatus according to claim 1, wherein the projection portion of the cathode is disposed in both an outer surface of the insulating member and an inner surface of the recess.

6. An image display apparatus comprising the electron beam apparatus according to claim 1, and a light emission member that is located while laminated on the anode.

* * * * *